US006896154B1

(12) United States Patent
Lomeli

(10) Patent No.: US 6,896,154 B1
(45) Date of Patent: May 24, 2005

(54) PASTE DISPENSER AND IMPLEMENT HOLDING DEVICE

(76) Inventor: Francisco J. Lomeli, 4440 W. 153rd St., Lawndale, CA (US) 90260

( * ) Notice: Subject to any disclaimer, the term of this patent is extended or adjusted under 35 U.S.C. 154(b) by 0 days.

(21) Appl. No.: 10/436,481

(22) Filed: May 12, 2003

(51) Int. Cl.[7] ..... B65D 35/28
(52) U.S. Cl. ..... 222/102; 222/101
(58) Field of Search ..... 222/101, 102

(56) References Cited

U.S. PATENT DOCUMENTS 2,099,906 A 11/1937 Reese et al.
2,124,907 A * 7/1938 Bunting ..... 222/93
2,528,662 A * 11/1950 Miller ..... 222/101
3,860,147 A 1/1975 Vessio et al.
4,421,252 A 12/1983 Ylitalo
D286,348 S 10/1986 Gaudet et al.
5,178,302 A * 1/1993 Cheng ..... 222/102
5,203,473 A 4/1993 Willey
5,487,877 A 1/1996 Choi

* cited by examiner

*Primary Examiner*—J. Casimer Jacyna

(57) ABSTRACT

A paste dispenser and implement holding device includes a housing adapted for coupling to a wall surface. The housing has a pair of aligned slots. A pair of roller members is coupled to the housing and positioned in alignment with the pair of aligned slots. The roller members are positioned in spaced relationship to each other whereby the roller members are adapted for frictionally engaging a tube of paste such that paste is dispensed from the tube as the tube of paste passes between the pair of roller members. A roller knob is operationally coupled to one of the pair of roller members whereby turning the roller knob rotates the one of the pair of roller members. The housing includes a plurality of openings, each opening is adapted for receiving an implement for holding the implement.

14 Claims, 6 Drawing Sheets

PASTE DISPENSER AND IMPLEMENT HOLDING DEVICE

BACKGROUND OF THE INVENTION

1. Field of the Invention

The present invention relates to paste dispenser and implement holding devices and more particularly pertains to a new paste dispenser and implement holding device for providing a user with a storage unit that would keep oral care products organized and readily available.

2. Description of the Prior Art

The use of paste dispenser and implement holding devices is known in the prior art. U.S. Pat. No. 5,203,473 describes a toothpaste dispenser apparatus for dispensing toothpaste. Another type of paste dispenser and implement holding device is U.S. Pat. No. 4,421,252 describing a toothpaste dispensing device. U.S. Pat. No. 2,099,906 describes an article holder for holding toothbrushes and razors. U.S. Pat. No. 3,860,147 describes a dental hygiene dispenser for dispensing dentifrice onto a toothbrush. U.S. Pat. No. 5,487,877 describes a restroom organizer and sterilizing apparatus that includes a toothbrush sterilizer. U.S. Pat. No. Des. 286,348 describes a design for a bathroom cabinet.

While these devices fulfill their respective, particular objectives and requirements, the need remains for a device that includes a versatile device for dispensing toothpaste and storing toothbrushes, razors and other bathroom utensils.

SUMMARY OF THE INVENTION

The present invention meets the needs presented above by providing a device that incorporates a paste dispensing device with a utensil holder that can be mounted several different ways.

Still yet another object of the present invention is to provide a new paste dispenser and implement holding device that would save the user time, energy, and aggravation associated with searching through drawers, cabinets, and other locations for toothpaste, their toothbrush, and a razor.

Even still another object of the present invention is to provide a new paste dispenser and implement holding device that allow the user to easily dispense toothpaste while utilizing the entire contents of the toothpaste tube.

To this end, the present invention generally comprises a housing adapted for coupling to a wall surface. The housing has a pair of aligned slots adapted for receiving a tube of paste therethrough. A pair of roller members is coupled to the housing and positioned in alignment with the pair of aligned slots such that the pair of roller members is adapted for holding the tube of paste when the tube of paste is inserted through the pair of aligned slots. The pair of roller members is positioned in spaced relationship to each other whereby the roller members are adapted for frictionally engaging the tube of paste such that paste is dispensed from the tube as the tube of paste passes between the pair of roller members. A roller knob is operationally coupled to one of the pair of roller members whereby turning the roller knob rotates the one of the pair of roller members. The housing includes a plurality of openings, each opening is adapted for receiving an implement for holding the implement.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
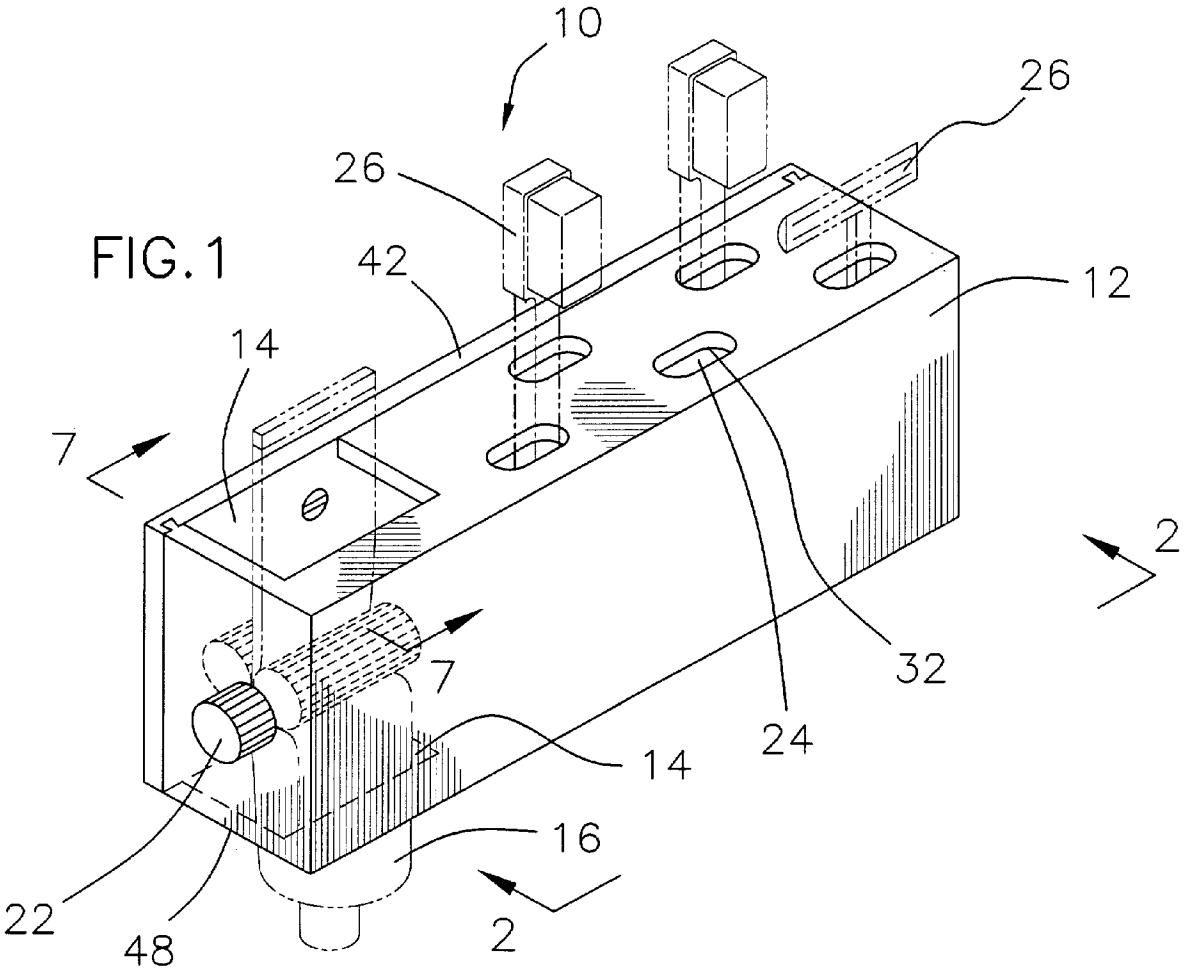
FIG. 1 is a perspective view of a new paste dispenser and implement holding device according to the present invention.
Figure 2:
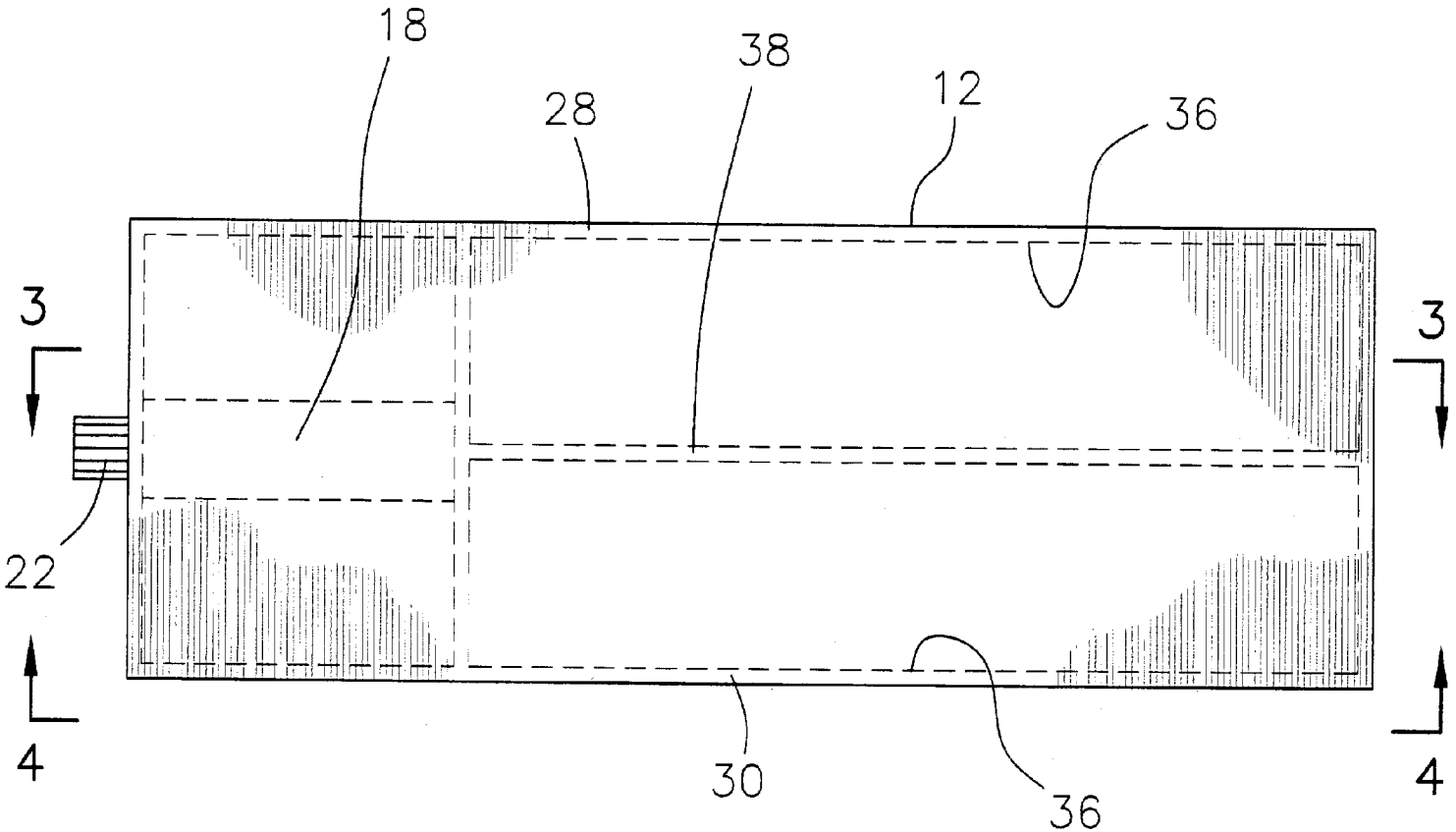
FIG. 2 is a cross-sectional view of the present invention.
Figure 3:
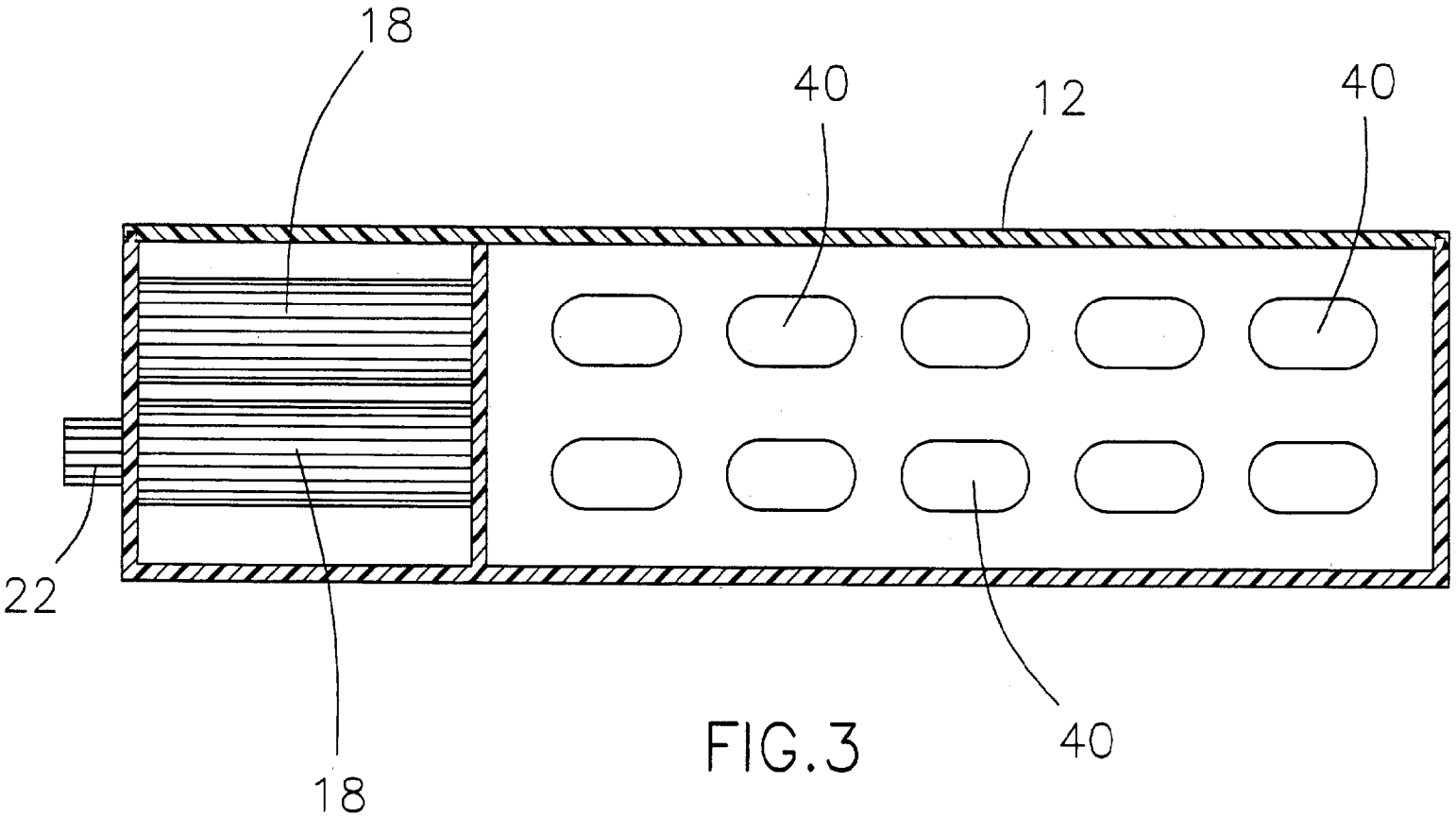
FIG. 3 is a top cross-sectional view of the present invention.
Figure 4:
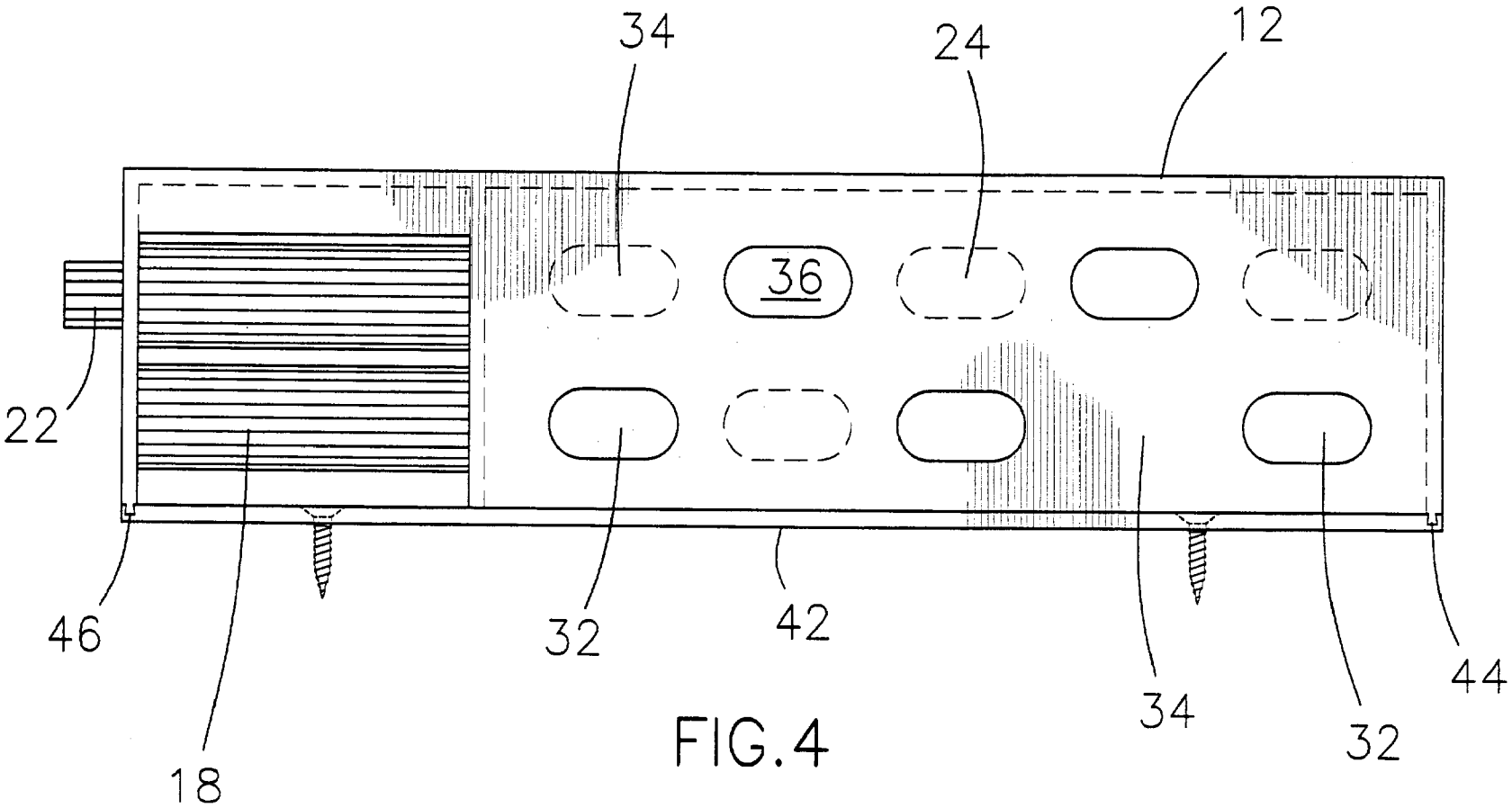
FIG. 4 is a top view of the present invention.
Figure 5:
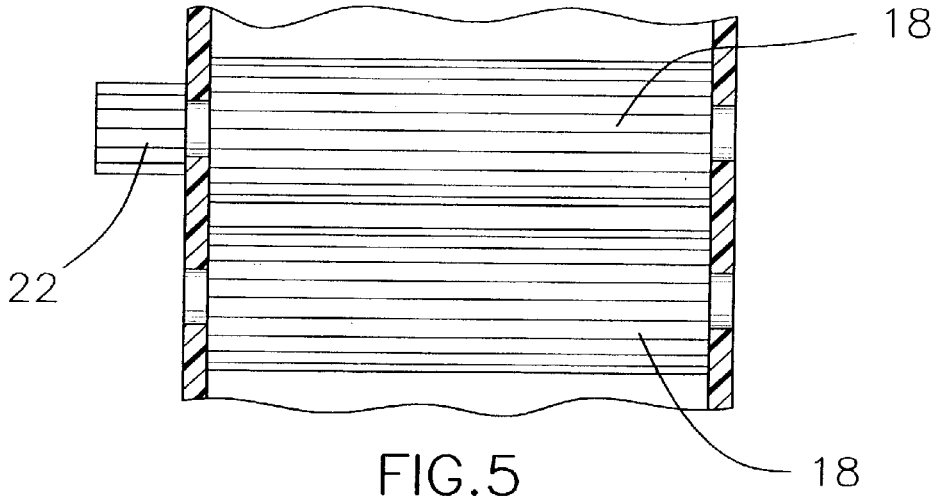
FIG. 5 is a top cross-sectional view of the present invention.
Figure 6:
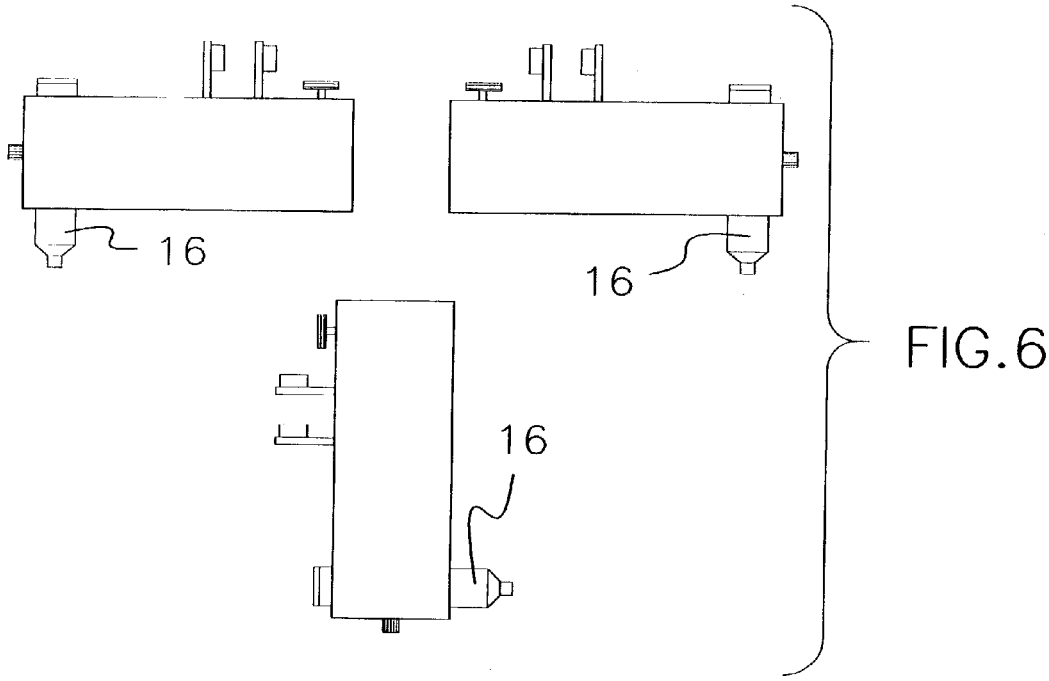
FIG. 6 is a front view of the present invention.
Figure 7:
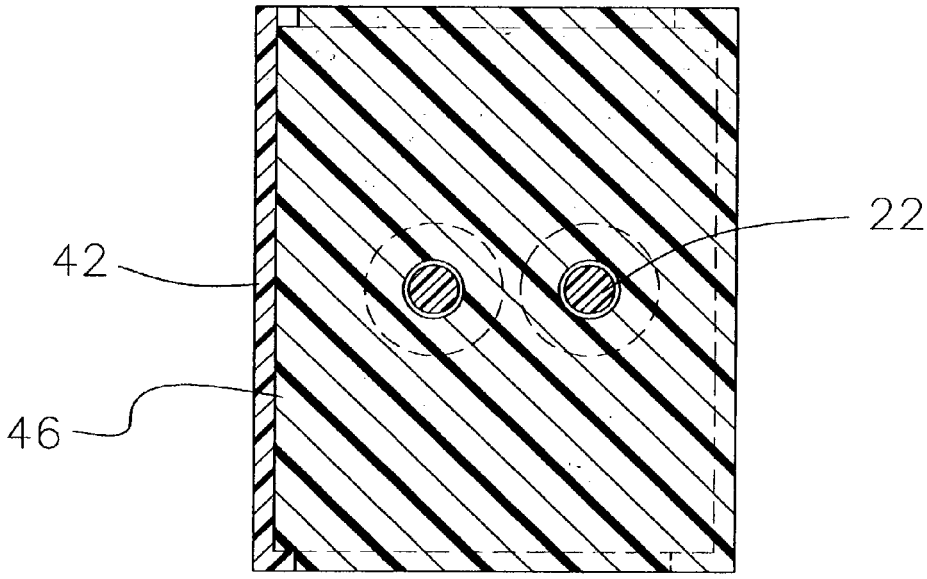
FIG. 7 is a cross-sectional view of the present invention.

With reference now to the drawings, and in particular to FIGS. 1 through 7 thereof, a new paste dispenser and implement holding device embodying the principles and concepts of the present invention and generally designated by the reference numeral 10 will be described.

As best illustrated in FIGS. 1 through 7, the paste dispenser and implement holding device 10 generally comprises a housing 12 adapted for coupling to a wall surface. The housing 12 has a pair of aligned slots 14 adapted for receiving a tube 16 of paste therethrough. A pair of roller members 18 is coupled to the housing 12 and positioned in alignment with the pair of aligned slots 14 such that the pair of roller members 18 is adapted for holding the tube 16 of paste when the tube 16 of paste is inserted through the pair of aligned slots 14. The pair of roller members 18 is positioned in spaced relationship to each other whereby the roller members 18 are adapted for frictionally engaging the tube 16 of paste such that paste is dispensed from the tube 16 as the tube 16 of paste passes between the pair of roller members 18. A roller knob 22 is operationally coupled to one of the pair of roller members 18 whereby turning the roller knob 22 rotates the one of the pair of roller members 18. The housing 12 includes a plurality of openings 24, each opening is adapted for receiving an implement for holding the implement 26.

Each of the pair of roller members 18 has a knurled outer surface for facilitating frictional engagement between the roller members 18 and the tube 16 of paste. The housing 12 has a first side 28 and a second side 30. Each of the aligned slots 14 is in an associated one of the first 28 and second 30 sides of the housing 12. The plurality of openings 24 in the housing 12 includes a plurality of first side openings 32 in the first side 28 of the housing 12 and a plurality of second side openings 34 in the second side 30 of the housing 12. The first side openings 32 and the second side openings 34 is offset from each other whereby an interior surface 36 of the first side 28 is positioned to support an implement inserted through one of the second side openings 34 when the housing 12 is positioned with the second side 30 facing up and an interior surface 36 of the second side 30 is positioned to support an implement 26 inserted through one of the first side openings 32 when the housing 12 is positioned with the first side facing up.

A medial support member 38 extends through the housing 12 between the first side 28 and the second side 30. The medial support member 38 has a plurality of apertures 40. Each of the apertures 40 is aligned with an associated one of the first 32 and second 34 side openings. The housing 12 includes a rear panel 42. The rear panel 42 is adapted for coupling to the wall surface. The rear panel 42 is removable from a remainder of the housing 12 to facilitate cleaning of the remainder of the housing 12. The rear panel 42 has a pair of grooves 44 extending inwardly from an edge of the rear panel 42.

The remainder of the housing 12 has a pair of tongues 46. Each tongue 46 is complimentary to the grooves 44 for permitting insertion of the tongues 46 into the grooves 44 for positioning the housing 12 in a selectable orientation. Ends of each of the tongues 46 is offset from an edge of the remainder of the housing 12 such that a bottommost face 48 of the remainder of the housing 12 is positioned flush with a bottom face of the rear panel 42 when the tongues 46 are fully inserted into the grooves 44.

In use, the present invention would be mounted to a support surface. It would provide convenient access to a toothbrush, toothpaste and even a razor when needed. The toothpaste slot would feature a set of roller members that would effortlessly release the toothpaste from the tube.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paste dispenser and implement holding device comprising:

a housing adapted for coupling to a wall surface;

said housing having a pair of aligned slots adapted for receiving a tube of paste therethrough;

a pair of roller members coupled to said housing and positioned in alignment with said pair of aligned slots such that said pair of roller members is adapted for holding the tube of paste when the tube of paste is inserted through said pair of aligned slots;

said pair of roller members being positioned in spaced relationship to each other whereby said roller members are adapted for frictionally engaging the tube of paste such that paste is dispensed from said tube as the tube of paste passes between said pair of roller members;

a roller knob operationally coupled to one of said pair of roller members whereby turning said roller knob rotates said one of said pair of roller members;

said housing including a plurality of openings, each opening being adapted for receiving an implement for holding said implement;

said housing having a first side and a second side, each of said aligned slots being in an associated one of said first and second sides of said housing;

said plurality of openings in said housing including a plurality of first side openings in said first side of said housing and a plurality of second side openings in said second side of said housing; and said first side openings and said second side openings being offset from each other whereby an interior surface of said first side is positioned to support an implement inserted through one of said second side openings when said housing is positioned with said second side facing up and an interior surface of said second side is positioned to support an implement inserted through one of said first side openings when said housing is positioned with said first side facing up.

2. The paste dispenser and implement holding device of claim 1, further comprising:

each of said pair of roller members having a knurled outer surface for facilitating frictional engagement between said roller members and the tube of paste.

3. The paste dispenser and implement holding device of claim 1, further comprising:

a medial support member extending through said housing between said first side and said second side, said medial support member having a plurality of apertures, each of said apertures being aligned with an associated one of said first and second side openings.

4. The paste dispenser and implement holding device of claim 1, further comprising:

said housing including a rear panel, said rear panel being adapted for coupling to the wall surface, said rear panel being removable from a remainder of said housing to facilitate cleaning of said remainder of said housing.

5. The paste dispenser and implement holding device of claim 4, further comprising:

said rear panel having a pair of grooves extending inwardly from an edge of said rear panel;

said remainder of said housing having a pair of tongues, each tongue being complimentary to said grooves for permitting insertion of said tongues into said grooves for positioning said housing in a selectable orientation.

6. The paste dispenser and implement holding device of claim 5, further comprising:

ends of each of said tongues being offset from an edge of said remainder of said housing such that a bottommost face of said remainder of said housing is positioned flush with a bottom face of said rear panel when said tongues are fully inserted into said grooves.

7. The paste dispenser and implement holding device of claim 1, further comprising:

each of said pair of roller members having a knurled outer surface for facilitating frictional engagement between said roller members and the tube of paste;

a medial support member extending through said housing between said first side and said second side, said medial support member having a plurality of apertures, each of said apertures being aligned with an associated one of said first and second side openings;

said housing including a rear panel, said rear panel being adapted for coupling to the wall surface, said rear panel being removable from a remainder of said housing to facilitate cleaning of said remainder of said housing;

said rear panel having a pair of grooves extending inwardly from an edge of said rear panel;

said remainder of said housing having a pair of tongues, each tongue being complimentary to said grooves for permitting insertion of said tongues into said grooves for positioning said housing in a selectable orientation;

ends of each of said tongues being offset from an edge of said remainder of said housing such that a bottommost face of said remainder of said housing is positioned flush with a bottom face of said rear panel when said tongues are fully inserted into said grooves.

8. A paste dispenser and implement holding device comprising:

a housing adapted for coupling to a wall surface;

said housing having a pair of aligned slots adapted for receiving a tube of paste therethrough;

a pair of roller members coupled to said housing and positioned in alignment with said pair of aligned slots such that said pair of roller members is adapted for holding the tube of paste when the tube of paste is inserted through said pair of aligned slots;

said pair of roller members being positioned in spaced relationship to each other whereby said roller members are adapted for frictionally engaging the tube of paste such that paste is dispensed from said tube as the tube of paste passes between said pair of roller members;

a roller knob operationally coupled to one of said pair of roller members whereby turning said roller knob rotates said one of said pair of roller members;

said housing including a plurality of openings, each opening being adapted for receiving an implement for holding said implement;

said housing having a first side and a second side, each of said aligned slots being in an associated one of said first and second sides of said housing;

said plurality of openings in said housing including a plurality of first side openings in said first side of said housing and a plurality of second side openings in said second side of said housing; and a medial support member extending through said housing between said first side and said second side, said medial support member having a plurality of apertures, each of said apertures being aligned with an associated one of said first and second side openings.

9. The paste dispenser and implement holding device of claim 8, further comprising:

each of said pair of roller members having a knurled outer surface for facilitating frictional engagement between said roller members and the tube of paste.

10. The paste dispenser and implement holding device of claim 8, further comprising:

said housing including a rear panel, said rear panel being adapted for coupling to the wall surface, said rear panel being removable from a remainder of said housing to facilitate cleaning of said remainder of said housing.

11. The paste dispenser and implement holding device of claim 10, further comprising:

said rear panel having a pair of grooves extending inwardly from an edge of said rear panel;

said remainder of said housing having a pair of tongues, each tongue being complimentary to said grooves for permitting insertion of said tongues into said grooves for positioning said housing in a selectable orientation.

12. The paste dispenser and implement holding device of claim 11, further comprising:

ends of each of said tongues being offset from an edge of said remainder of said housing such that a bottommost face of said remainder of said housing is positioned flush with a bottom face of said rear panel when said tongues are fully inserted into said grooves.

13. A paste dispenser and implement holding device comprising:

a housing adapted for coupling to a wall surface;

said housing having a pair of aligned slots adapted for receiving a tube of paste therethrough;

a pair of roller members coupled to said housing and positioned in alignment with said pair of aligned slots such that said pair of roller members is adapted for holding the tube of paste when the tube of paste is inserted through said pair of aligned slots;

said pair of roller members being positioned in spaced relationship to each other whereby said roller members are adapted for frictionally engaging the tube of paste such that paste is dispensed from said tube as the tube of paste passes between said pair of roller members;

a roller knob operationally coupled to one of said pair of roller members whereby turning said roller knob rotates said one of said pair of roller members;

said housing including a plurality of openings, each opening being adapted for receiving an implement for holding said implement;

said housing including a rear panel, said rear panel being adapted for coupling to the wall surface, said rear panel being removable from a remainder of said housing to facilitate cleaning of said remainder of said housing;

said rear panel having a pair of grooves extending inwardly from an edge of said rear panel;

said remainder of said housing having a pair of tongues, each tongue being complimentary to said grooves for permitting insertion of said tongues into said grooves for positioning said housing in a selectable orientation; and ends of each of said tongues being offset from an edge of said remainder of said housing such that a bottommost face of said remainder of said housing is positioned flush with a bottom face of said rear panel when said tongues are fully inserted into said grooves.

14. The paste dispenser and implement holding device of claim 13, further comprising:

each of said pair of roller members having a knurled outer surface for facilitating frictional engagement between said roller members and the tube of paste.

* * * * *